United States Patent [19]

Glomeau

[11] Patent Number: 4,696,163

[45] Date of Patent: Sep. 29, 1987

[54] CONTROL VALVE AND HYDRAULIC SYSTEM EMPLOYING SAME

[75] Inventor: J. Robert Glomeau, Dover, Mass.

[73] Assignee: REXA Corporation, Dover, Mass.

[21] Appl. No.: 674,537

[22] Filed: Nov. 16, 1984

[86] PCT No.: PCT/US84/00448

§ 371 Date: Nov. 16, 1984

§ 102 Date: Nov. 28, 1984

[87] PCT Pub. No.: WO84/03916

PCT Pub. Date: Oct. 11, 1984

[22] PCT Filed: Mar. 22, 1984

Related U.S. Application Data

[63] Continuation-in-part of Ser. No. 479,672, Mar. 28, 1983, Pat. No. 4,557,180, and Ser. No. 479,673, Mar. 28, 1983, Pat. No. 4,625,513.

[51] Int. Cl.[4] ..... F15B 13/04; F15B 9/03

[52] U.S. Cl. ..... 60/476; 60/390

[58] Field of Search ..... 60/390, 430, 436, 392, 60/472, 476; 91/451, 452, 390, 468

[56] References Cited

U.S. PATENT DOCUMENTS

| | | | |
|---|---|---|---|
| 2,702,044 | 2/1955 | Johnson | 137/102 |
| 3,593,522 | 7/1971 | Angert et al. | 60/436 |
| 4,557,180 | 12/1985 | Glomeau | 91/446 |

FOREIGN PATENT DOCUMENTS

| | | | |
|---|---|---|---|
| 2757623 | 6/1979 | Fed. Rep. of Germany | 60/476 |

*Primary Examiner*—Gerald A. Michalsky
*Attorney, Agent, or Firm*—Pahl, Lorusso & Loud

[57] ABSTRACT

The valve disclosed herein functions as a flow matching device. By employing such a valve, hydraulic systems may be implemented in which filling and emptying of a variable volume load, such as a hydraulic piston, may be accomplished through simple check valve structures at controlled flow rates.

2 Claims, 7 Drawing Figures

CONTROL VALVE AND HYDRAULIC SYSTEM EMPLOYING SAME

This application is a continuation-in-part of my prior application Ser. No. 479,672, filed Mar. 28, 1983, now U.S. Pat. No. 4,557,180 and of my prior application Ser. No. 479,673, filed Mar. 28, 1983, now U.S. Pat. No. 4,625,513.

BACKGROUND OF THE INVENTION

The present invention relates to a flow matching device and more particularly to a check valve structure facilitating simplified control of a hydraulic actuator.

As is understood by those skilled in the art, large process control valves, e.g. such as those employed in petroleum refineries and chemical and power plants are often driven by electrically controllable, hydraulic positioning systems. Such hydraulic positioning systems commonly includes a powerful, single-acting, spring-return hydraulic piston and a constant speed positive displacement pump which provides a source of hydraulic power, both for stroking the piston and for holding same at any selected position within its stroke. Typically the pump is run continuously and the pressure to the actuator is modulated by a convential three way servo valve or equivalent systems means such as a flapper nozzle or jet pipe system which relieve excess pressure to the sump. The servo valve, in turn, is responsive to an electrical command signal employed in conjunction with a position feedback loop.

While the actuator is immobile, the servo valve throttles the pump output in order to create the proper back pressure as required to hold the piston in position and the totality of the flow is returned to the pump sump when the piston is immobile. As a result of the continuous pump operation, the efficiency of present state-of-the-art hydraulic actuators system is, in the large majority of applications, in the order of five percent or less. Inherently a majority of the hydraulic energy generated by the pump is wasted as heat while the actuator is immobile at any intermediate positions. As is, in fact, immobile much of the time in most valve applications, particularly in large and rather stable processes. Not only is the loss of energy wasteful, the heat created is itself troublesome.

Among the several objects of the present invention may be noted the provision of a reciprocative check valve which selectively allows free flow through a single line port in either direction in order to selectively fill or unfill a variable volume load, e.g. to extend or retract the piston of a single-acting, spring-return actuator; the provision of such a reciprocative check valve which maintains the piston positions's volume with a single positive acting check valve when the piston is immobile; the provision of such a reciprocative check valve which adjusts the flow returning from the actuator to the flow from the hydraulic power source; the provision of electro hydraulic actuator in which the pump need be operated only when the piston is moving; the provision of such an actuator in which the piston position's volume is maintained by positive acting check valves when the piston is immobile; the provision of such a system which may be precisely controlled; the provision of such a system which has a symmetrical response; the provision of such a system which is reliable and which is of relatively simple and inexpensive construction. Other objects and features will be in part apparent and, in part, pointed out hereinafter.

SUMMARY OF THE INVENTION

A hydraulic system in accordance with one aspect of the present invention employs a pump which draws fluid from a sump to provide fluid under pressure. Located between the pump and the load is a reciprocative check valve having first and second mating pairs of valving surfaces which are mechanically coupled and arranged to open in synchronism when the pump pressure exceeds the load pressure. These valving surfaces are connected in series between the pump and the load with the connection between the two pairs of valving surfaces being connected also, through a release valve, to the sump. When the release valve is closed, operation of the pump will expand the load volume and, when the release valve is open, operation of the pump will contract the load volume.

In accordance with another aspect of the invention, the reciprocative check valve or flow matching valve is a device employing a tubular body structure having a source port at a first axial position along the body and a load port at a second position along the body which is axially displaced from the first position. A drain port is located between the source and load ports. In the body, there is a plug member which is movable axially in response to any difference in the pressures at the source and load ports. The plug member includes rigidly connected mating surfaces which progressively open the source and load ports in synchronism. When opened, the source and load ports each connect with a drain port. A common or separate drain port may be provided depending on the end use application. When a common drain port is used and is closed, a hydraulic flow into the source port will exit through the load port and, when the drain port is open, a hydraulic flow into the source port will produce a controlled flow through the load port, both flows exiting the valve through the drain port.

BRIEF DESCRIPTION OF THE DRAWINGS

Corresponding references characters indicate corresponding parts throughout the several views of the drawings.

DESCRIPTION OF THE PREFERRED EMBODIMENT AND PRIOR ART

Figure 1:
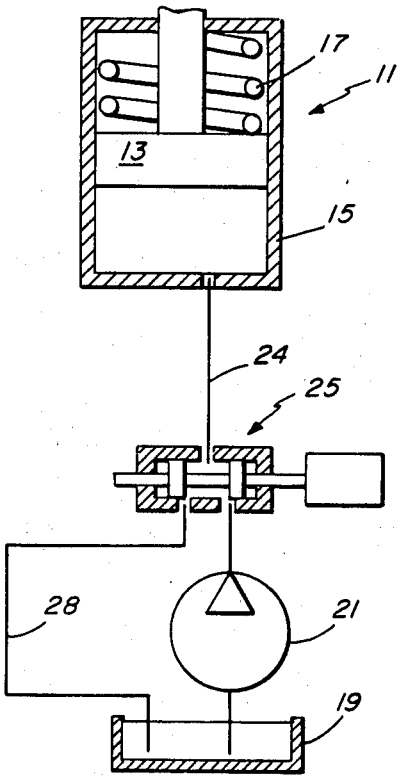
FIG. 1 PRIOR ART
FIG. 1 is a somewhat diagrammatic illustration of a conventional circuit hydraulic actuator, i.e. in accordance with the prior art.

As indicated above, hydraulic actuators operating process control valves typically employ a relatively massive hydraulic prime mover. Referring now to FIG. 1, such a mover is indicated generally by reference character 11 and comprises a piston 13 and a cylinder 15. To provide a return force and a modicum of fail safe operation, the piston is normally biased by a heavy spring, as indicated at 17, toward a return position. Hydraulic fluid from a sump 19 is provided under pressure suitable for operating prime mover 11 by a unidirectional pump 21 which runs constantly. In the supply line 24 to the cylinder 15, a control valve, e.g. an electrically operated, spool type servo valve 25, is provided for modulating the pressure of the fluid as suitable for moving the prime mover piston or holding it at any position within the stroke range. The excess flow is returned to the pump sump 19 through line 28.

In such prior art systems, the pump cannot be stopped since it is normally impossible to put a positive acting check valve between the servo valve and the actuator to prevent drifting of the piston.

Figure 3:
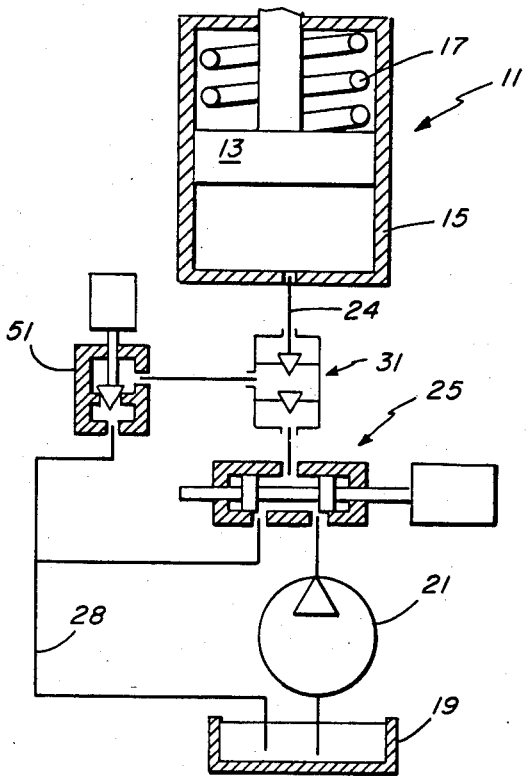
FIG. 3 is a diagrammatic illustration of a hydraulic actuator constructed in accordance with the present invention and employing a control valve in accordance with the present invention, that is, of the type illustrated in FIG. 2 or 4.
Figure 2:
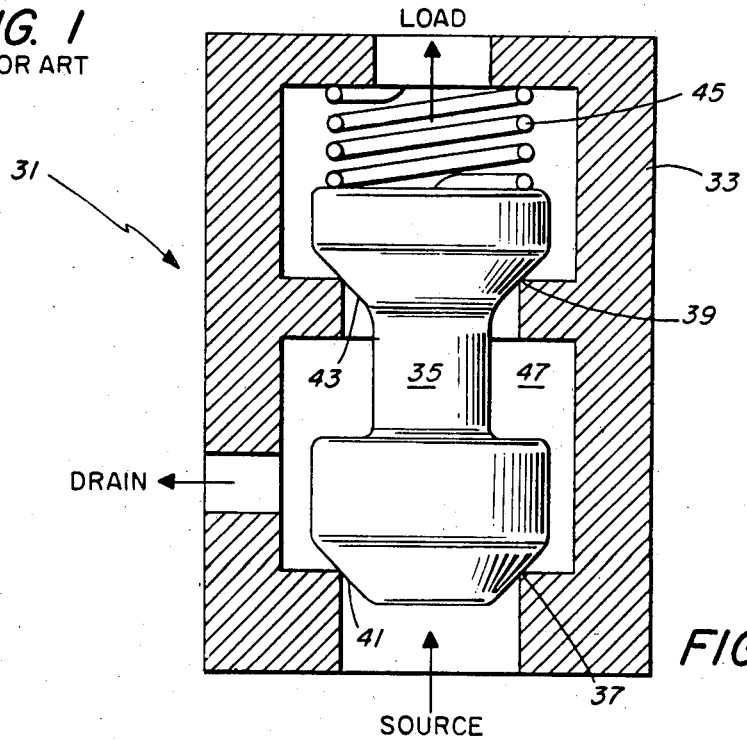
FIG. 2 is a cross-sectional view of a reciprocative check valve or flow matching valve constructed in accordance with the present invention.

This problem is alleviated by employing in such an hydraulic actuator circuit a flow-matching or reciprocative check valve in accordance with the present invention. A relatively simple version of such a valve is illustrated in FIG. 3 and serves well for the purpose describing the basic valve function and overall system operation. Referring now to FIG. 2, the valve illustrated there comprises a generally cylindrical or tubular body portion 33 within which operates a plug member 35. The overall control valve structure is designated by reference character 31. The valve body 33 provides a first valve seat 37 and a second valve seat 39 which is axially displaced along the body from the first valve seat. Both valve seats face in the same direction and are of the same diameter.

The plug member 35 includes a first valving surface 41 and a second valving surface 43 which mate with the seats 37 and 39 respectfully. The axial displacement between the valving surfaces 41 and 43 matches the axial spacing of the seats 37 and 39 so that the two ports open synchroniously. The port controlled by the valving surface 41 in cooperation with the seat 37 may be considered the source or supply port while the port controlled by the second valving surface 43 in conjunction with the second valve seat 39 may be considered the load port. While the plug member 35 is preferably lightly biased in the direction tending to close the ports, e.g. by a spring 45, the plug member is essentially floating in the body so as to be responsive to any difference in pressure between the supply side and the load side.

The valve body 33 and plug member 35 provide, between them, an intermediate chamber 47. A drain port opens into chamber 47, as indicated at reference character 49. While the valve body 33 and plug member 35 are illustrated as integral structures for the purpose of explanation, it will be understood by those skilled in the mechanical arts that these parts are necessarily assembled of multiple components so as to permit the construction of interlocking assembly shown in the drawings.

The valve 31 of FIG. 2 is functional to provide flow matching characteristics and, in effect, reciprocative check valving. This operation may best be understood in conjunction with the description of an overall system, such as that illustrated in FIG. 3. As may be seen, the control valve of FIG. 2 is installed in the supply line 24 in the place of the check valve 27. However, the return line 28 is also connected to the drain port of the valve 31. In series with the drain port is a simple two way directional valve, e.g. a solenoid operated on-off valve, designated by reference character 51. As is explained in greater detail hereinafter, the utilization of a simple on/off valve for unfilling the cylinder is possible since the single control valve 25 is functional during both filling and emptying of the piston 13.

At this point, it is useful to consider FIGS. 2 and 3 together. Assuming that the drain port 49 is closed off, i.e. the solenoid valve 51 is closed, it can readily be seen in that a hydraulic flow into the source port of the valve 31 will proceed through the intermediate chamber 47 and on out through the load port. As will be understood, the filling of the cylinder 15 in this situation can be controlled by the operation of the throttling valve 25. Further, when the supply pressure drops below the pressure in the cylinder 15, the control valve 31 acts as a positive operating check valve to prevent any backflow from the piston.

To reduce the volume of hydraulic fluid in the cylinder 15, the drain port 49 must be opened i.e., by opening the on/off valve 51. However, the mere opening of this value will not permit the piston to retract if the servo valve is not delivering pressure to the source port. If, though, the servo valve is then operated so that a hydraulic flow is introduced into the source port of the control valve 31 while its drain port is open, it can be seen that this flow will return back to the sump as soon as the source pressure equals the load pressure and moves the plug member 35 sufficiently to open the source port.

However, once the plug member 35 moves, the load port is also opened by the same amount as the source port. As noted previously, the valving surface in the two ports are of equal diameter and, therefore, of equal area. Further, since the pressure on the load side is necessarily about equal to that on the source side and since the drain pressure is the same for the two flows, it can bee seen that the pressure drop across the two valving surfaces will be equal. Accordingly it will be understood that substantially equal flows will occur from the source and load sides. In this way the control valve 31 operates as a flow matching device, that is, the flow out of the piston will be equal to the flow into the source port of the control value 31. As in the filling mode, this flow is controllable by means of the throttling valve 25. In addition, the control valve 31 also operates as a check valve with respect to the return line 30 since, even if the solenoid valve is open and the pump pressure drops below the load pressure, no back flow will take place.

Since the flow out of the piston 31 is controlled by the same servo or throttling valve 35 which controls filling flow and, since the servo valve is operating under essentially the same pressure differential conditions in both situation, it can be seen that essentially symmetrical operation is attained for both filling and emptying of the cylinder and that this will facilitate implementation of an overall servo control system within which such hydraulic actuators are typically employed. Further, if desired, valves 51 and 25 can be combined in a single spool valve type structure.

While the operation of the relatively simple valve shown in FIG. 2 is readily understood so that it serves well for the purpose of illustration, it will be understood by those skilled in the art that the balanced operation of such a construction at small flows becomes highly dependent on the accuracy with which the critical dimensions may be matched, i.e. the length of the plug member 35 between the surfaces 41 and 43 as compared with the actual separation between the valve seats 37 and 39. Maintenance of critical dimensions is facilitated with the arrangement shown in FIG. 4 and this construction is presently preferred.

Figure 4:
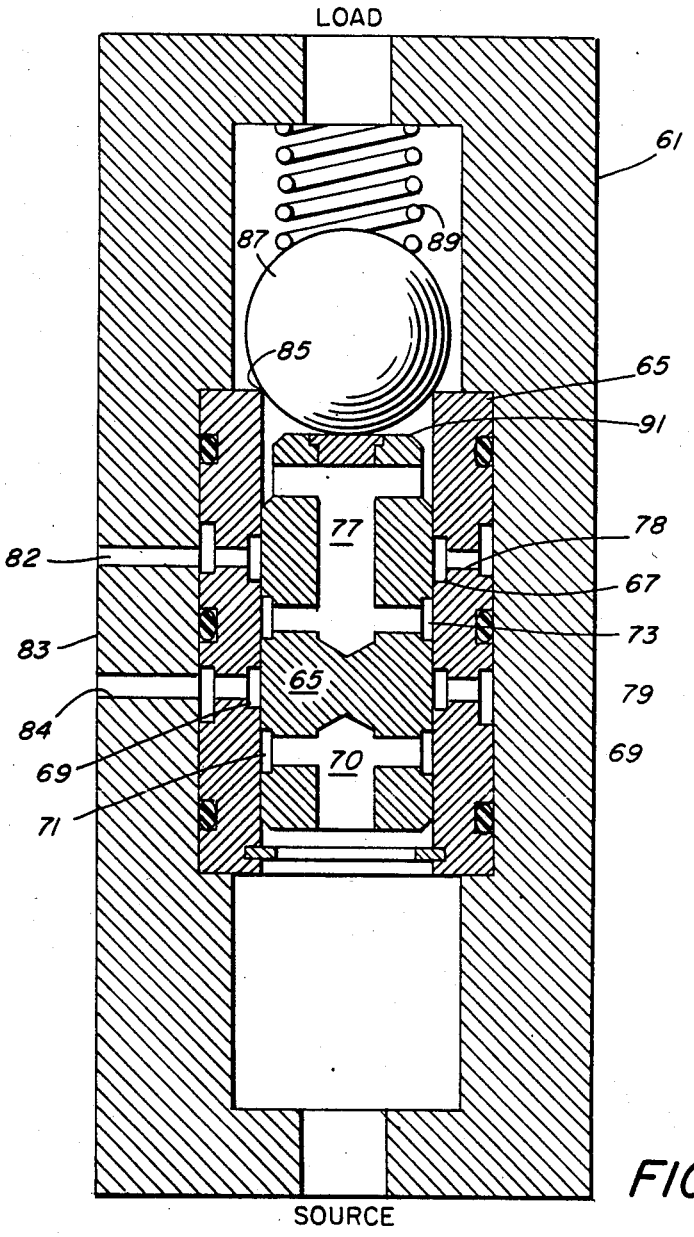
FIG. 4 is a cross sectional view of a preferred mechanical construction of a control valve in accordance with the present invention.

With reference to the device shown in FIG. 4, it will be apparent to those skilled in the art that the constructional techniques are quite similar to those employed in the making of spool valves where close tolerances are regularly achieved. Fitting within an overall body assembly 61 is a sleeve 63 and a piston 65. Sleeve 65 is stationary within the body member 61 while the piston 65 is slidable axially within the sleeve 63, i.e. similar to the manner in which the spool element in a spool valve is slidable. Preferably, the piston is lapped to the sleeve to provide a close, low leakage fit. The sleeve 63 is provided with a pair of internal annular grooves 67 and 69 with a precise axial separation between them. The piston 65 is provided with a matching pair of external annular grooves 71 and 73 with an axial separation between these grooves which matches the axial separation between the grooves 67 and 69 on the sleeve.

Within the piston 65 a first passageway system 70 connects the groove 71 with the source port while a second passageway system 77 provides communication from the groove 73 to the load port end of the sleeve 63. Cross ports 78 and 79 in the sleeve connect the grooves 67 and 69, to a respective pair of drain ports 82 and 84 in the valve body 61. When employed in the system shown in FIG. 3, the drain ports 82 and 84 are connected together externally of the body 61 to form a common drain functioning in the same manner as the single drain of the sample valve of FIG. 2. However, in other systems, such as the double acting cylinder system described hereinafter with respect to FIG. 7, it is advantageous to utilize separate drain paths from the source and load with a pressure barrier, i.e. a sealed land, therebetween. These are referred to hereinafter as the source drain and the load drain respectively.

The upper end of the sleeve 63 provides a valve seat, as indicated by reference character 85 and a spherical valving element 87 is lightly biased into contact with this seat by a spring 89. A projecting portion 91 of the piston 65 is formed to lift the valving element 87 from the seat 85 just as the annular grooves on the piston come adjacent the respective annular grooves on the sleeve 63.

Ignoring for a moment the action of the spherical valving element 87, it can be understood that the cooperative action of the piston and sleeve portion of the valve is essentially similar to the action provided by the valve of FIG. 2. As the pressure at the source port comes equal to that at the load port, the piston moves upwardly, opening the two valving sections in synchronism. If the drain ports are connected but closed, fluid flow introduced into the source port will proceed, through the drain ports, on to the load port. If the drain ports are open, however, matching flows from the source port and the load port will exit through the drain ports. These flows will be well matched in volume since the valve openings are closely matched and since the pressure drop in each channel will be equal.

This basic operation is not changed by the presence of the spherical valving element at the top of the sleeve since the spherical valving element 87 is lifted from the valve seat at the same time or slightly before the annular grooves open to each other. However, any time the source pressure drops significantly below the load pressure the spherical valving element acts as a simple but highly effective check valve eliminating backflow from the load. Since the desired sealing requirement is met by this element, there is no requirement for an absolute seal between the piston and the sleeve. Since the overall operation of the valve device of FIG. 4 in the system of FIG. 3 is basically the same as that of the valve device of FIG. 2, it will also be seen that the valve device of FIG. 4 may be directly substituted in the novel hydraulic system of FIG. 3 which will continue to provide the desired function and advantages.

Figure 5:
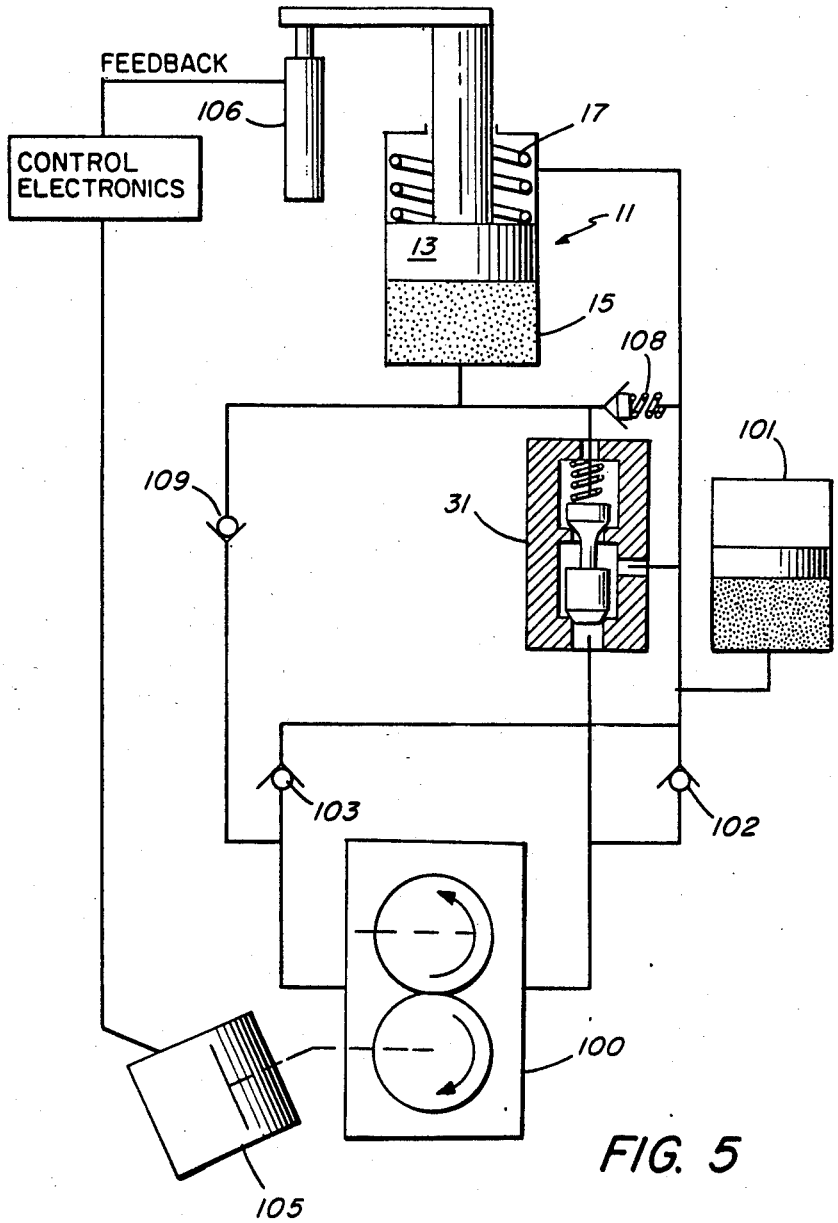
FIG. 5 is a diagrammatic illustration of a hydraulic actuator system constructed in accordance with the present invention and employing a bi-directional variable speed pump in cooperation with a flow matching valve.

The flow matching characteristics of values constructed in accordance with the present invention may also be advantageously utilized in systems where a variable speed bidirectional pump is available. Referring now to FIG. 5, a bidirectional positive displacement pump 100 is utilized for providing hydraulic fluid under a pressure suitable for operating a cylinder, again indicated by reference character 15. A pressurized accumulator 101 provides a reservoir of hydraulic fluid. This reservoir is connected, through respective check valves 102 and 103, to both sides of pump 100. Pump 100 is preferably of the positive displacement, meshing gear type and is driven in either direction by a stepping motor 105. Movement of the piston 13 is tracked by a suitable transducer e.g. a side wire potentiometer as indicated at 106, so as to provide a suitable feedback signal or voltage. A pressure release valve is provided, as indicated by reference character 108, for limiting the maximum pressure which can be applied to the cylinder 15. The cylinder 15 is connected, through a check valve 109, to one side of the pump and, through a flow matching control valve 31, to the other side of the pump.

The relatively simple version of the flow-matching control valve is illustrated in FIG. 5 and serves well for the purpose describing the overall system operation but it should be understood that the construction shown in FIG. 4 is presently preferred. When the pump 100 is driven in a direction producing flow from right to left as seen in FIG. 5, flow from the high pressure side of the pump is blocked by the check valve 103 but is passed by the check valve 109 so that flow increases the operating volume of the cylinder 15. In this situation, the control valve 31 acts simply as a positively operating check valve.

When the pump is driven in the opposite direction, producing flow from the left to right as seen in FIG. 1, the flow from the high pressure side of the pump is blocked by the check valve 102 but is admitted into the source port of the control valve 31. As soon as the pressure at the high pressure side of the pump equals the the load pressure, i.e. the pressure in the cylinder 15, the plug member is lifted from the valve seats opening the source port. However, at the same time that the source port of the control valve is open, the load port will also be opened by a like amount. Since the intermediate chamber is vented back to the accumulator 101, it can be seen that the flow generated by the pump will cause an equal flow to pass through the load port of the control valve, with both flows exiting the control valve through the drain port so as to return to the accumulator or sump. Because the emptying flow from the cylinder 15 is maintained substantially equal to the flow out of the pump, it can be seen that the overall sensitivity or "gain" of the hydraulic system is the same for both filling or emptying, a highly desirable attribute as will be understood by those skilled in the servo-control art.

Figure 6:
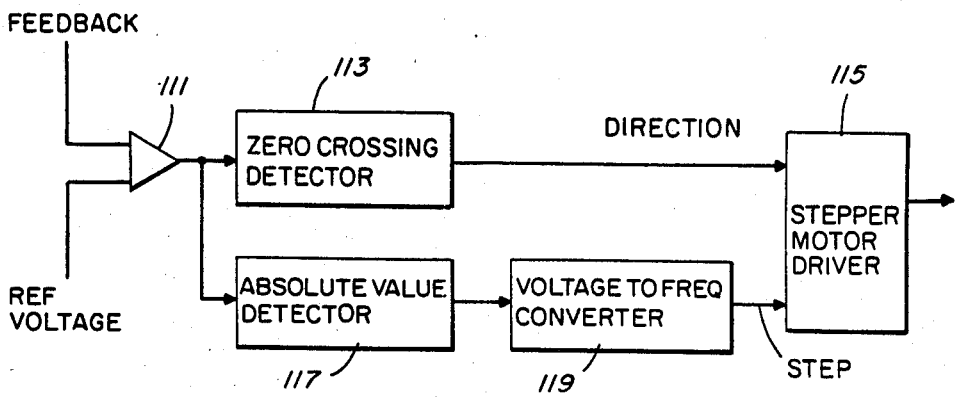
FIG. 6 is a block diagram of control electronics suitable for use in the actuator system of FIG. 5.

While various control schemes for controlling the operation of the pump 19 may be implemented, one particular such scheme is shown by way of example in FIG. 6. The feedback signal obtained from the potentiometer 106 is compared, in a differential amplifier 111, with a reference voltage representing the desired position of the piston thereby to generate an error signal representing the difference between the desired and actual positions for the piston. A zero crossing detector circuit 113 provides a signal indicating the sense of polarity of the error and this signal is provided to the direction control input of a conventional stepper motor driving circuit, indicated by reference character 115. A signal proportional to the amplitude of the error, independent of polarity, is provided by an absolute value detector circuit, indicated by reference character 117. As is understood, this circuitry may be constituted by a simple array of diodes. The signal porportional to the absolute value of the error is provided to enable a voltage-to-frequency converter circuit 119 whose output is, in turn, applied to the step signal input of the stepper motor driving circuit 115.

From the foregoing, it will be understood by those skilled in the art that the stepper motor 105 will be energized in a direction which reverses in accordance with the sensed direction of the error and at a speed which is proportional to the magnitude of the error. This operation thus closes the servo-loop so that the position of the piston will follow variations in the set point reference signal, as desired. However, as compared with conventional electro-hydraulic actuators in which the pump runs continuously, the stepper motor 105 is energized only when an error exists and the level of energization is proportional to the error. In relatively stable overall systems therefore, the motor is energized only intermittently.

As will be understood, this intermittent energization only when needed both reduces the average power requirement and the amount of heat dissipated in the system. Further, when the motor is not energized, the position of the piston 13 is maintained by positive acting check valve structures and is not a function of the leakage or backflow which would occur through the pump 19 if the load pressure were maintained across the pump itself. It may also be pointed out that, other than the the control valve 31, all of the valves in the system are essentially simple check valve constructions and no eleaborate reversing or four-way valves are required, as would typically be the case in conventional hydraulic servo control systems.

Figure 7:
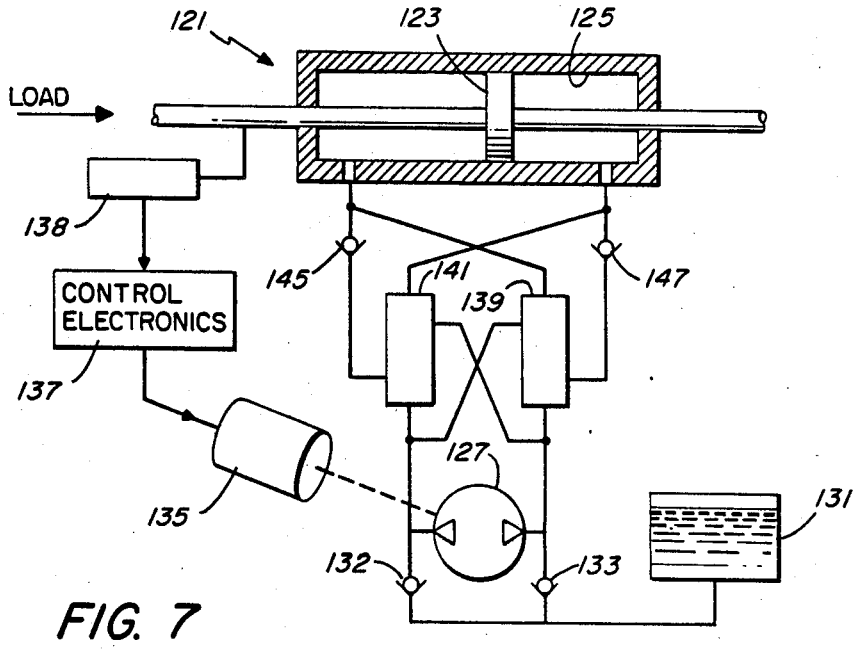
FIG. 7 is a diagrammatic illustration of a double acting hydraulic actuator system in accordance with the present invention.

The flow directing concepts of the present invention may also be advantageously applied to the control valving for a double acting or bidirectional hydraulic cylinder system if separate drain ports are utilized for the source and load ports. Referring now to FIG. 7, a prime mover is indicated generally by reference character 121 and comprises piston 123 and cylinder 125. The double rod ended piston provides equal annular area on both faces of the piston.

A bi-directional, positive displacement pump 127 is utilized for providing hydraulic fluid under a pressure suitable for operating the cylinder. A pressurized accumulator 131 provides a reservoir for the hydraulic fluid. This reservoir is connected through respective check valves 132 and 133 to both sides of the pump 127. Pump 127 is preferably of the positive displacement meshing gear type and is driven in either direction by a stepper motor 135 whose speed can be varied from zero to a maximum by means of suitable control electronics 137. Movement of the piston is tracked by a suitable transducer; e.g., a slide wire potentiometer indicated at 138 so as to provide a suitable feedback voltage or signal.

One side of the pump is connected to one side of the cylinder 121 through a hydraulic circuit which includes the source/source-drain path of a flow matching valve 139 and a check valve 147. The other side of the pump 127 is symmetrically connected through a hydraulic circuit which includes the source/source-drain path of a flow matching valve 141 and a check valve 145. Both flow matching valves 139 and 141 are identical in construction and size. The construction is preferably that illustrated in FIG. 4 with separate drain ports being maintained for the source and load ports.

Each side of the cylinder 121 is also cross connected to the load port of the opposite flow matching valve 139 or 141. Similarly, the load-drain port of each of the flow matching valves is cross connected to the source port of the other flow matching valve. In the following description of operation, it is assumed that a load is being applied to the piston 123 from the left side so that the right side of the cylinder is under greater pressure than the left side.

In order to drive the piston against the load, the pump 127 is driven so as to produce a flow from left to right as seen in the drawings. When the pressure at the outlet of the pump exceeds that of the low pressure side of the cylinder, initial opening of the paths through the flow matching valve 139 will occur and the pressure at the outlet side of the pump will then equalize with the high pressure side of the cylinder. Under continued pumping, flow will then occur through the source/source-drain path of the valve 139 and the check valve 147, driving the piston to the left. At the same time, an equal flow will return from the left side of the piston through the load/load-drain path of the control valve 139 to the low pressure side of the pump in a relatively straightforward manner.

When the pump 127 is operated in the opposite direction, i.e. producing flow from right to left as seen in FIG. 7, an essentially similar operation takes place but additional flow matching effects may come into play. Initially, when the pump output pressure reaches that on the high pressure side of the cylinder, the paths through the flow matching control valve 141 will start to open. Flow from the high pressure side of the cylinder will pass through the load/load-drain path of the control valve 141 back to the intake side of the pump allowing the piston to move to the right. At the same time, a matching flow will tend to pass through the source/source-drain path of the valve 141 and the check valve 145 to fill the expanding low pressure side of the piston. However, as may be seen, the load is aiding the motion and the pump 127 may be considered to be in a overrunning condition where the intake pressure may tend to exceed that on the low pressure side of the cylinder. Under this situation, the other, normally passive, flow matching valve 139 may open slightly.

The opening of the loaddrain/load path will bypass some of the pump's output allowing a partial reclosing of the flow matching valve 141 which therefore increases the restriction and reduces the flow from the high pressure side of the cylinder, thereby restoring balance.

Since the hydraulic circuit is entirely symmetrical, it can be seen that complementary actions are obtained if the load is applied to the piston in the opposite direction. An additional advantage of the symmetrical design of FIG. 7 is that, when the pump is stopped, the high pressure trapped under the plug of the active valve 131 will cause the passive valve plug to lift and relieve the said trapped pressure which would otherwise delay the closing of the high pressure load port causing the piston to creep. In addition, the pump is unloaded and ready for the next start thereby substantially eliminating any risk of the motor stalling.

Summarizing, it can be seen that the flow pumped into one side of the cylinder is always matched by the flow returned to the pump intake regardless of the direction of rotation of the pump and regardless of the direction of the load. Further, since this hydraulic circuit is entirely symmetrical, it follows that the high pressure and low pressure sides of the cylinder are only dictated by the direction of the load vector. Conversely, the response or sensitivity of the actuator is identical in both directions regardless of the direction of the load, a highly desirable attribute as will be understood by those skilled in the servo control art.

It may also be pointed out that, in relatively stable overall systems, the motor is energized only intermittently. as is understood, this both reduces the average power requirement and the amount of heat dissapated in the system. Furthermore, when the motor is not energized, the piston position is maintained by positive acting check valve structures and is not a function of the leakage or back flow which would occur through the pump if a load pressure were maintained across the pump itself. It may also be pointed out that all of the valves in this system, other than flow matching valves 139 and 141, are essentially simple check valve construction and no elaborate reversing, four way valves, or counter balancing valvs are required as would be the case in conventional hydraulic actuators.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

I claim:

1. A hydraulic system comprising:

a double acting piston and cylinder having first and second ports accessing opposite sides of the piston;

a bidirectional pump;

a pair of flow matching control valves each having a source port, a load port and a pair of drain ports, a hydraulic flow into the source port producing a controlled flow into the load port, the flows exiting through respective drain ports;

means connecting each side of said pump to the source port of a respective control valve;

means connecting the load port of each control valve to a respective one of said cylinder ports;

means connecting the load drain ports of each control valve to the source port of the other control valve; and check valve means connecting the source drain port of each control valve to the load port of the other control valve.

2. A hydraulic system comprising:

a fluid reservoir;

a bidirectional pump;

a double acting piston and cylinder having first and second ports accessing opposite sides of the piston;

a pair of flow matching control valves each having a generally tubular body, a source port at a first axial position along said body, a load port at a second position along said body which is axially spaced from said first position, and, in said body, an axially floating plug member which is movable axially responsive to any difference in the pressures at said source and load ports, said body including rigidly connected mating surfaces which progressively open said source and load ports to respective drain ports in synchronism;

means connecting said reservoir to both sides of said pump through respective check valves permitting flow from the reservoir toward the pump;

means connecting each side of said pump to the source port of a respective control valve;

means connecting the load port of each control valve to a respective one of said cylinder ports;

means connecting the load drain port of each control valve to the source port of the other control valve; and check valve means connecting the source drain of each control valve to the load port of the other control valve.

* * * * *